United States Patent [19]

Terwilliger

[11] 4,079,554

[45] * Mar. 21, 1978

[54] TILE ASSEMBLY

[75] Inventor: Bruce J. Terwilliger, Newburgh, N.Y.

[73] Assignee: GAF Corporation, New York, N.Y.

[ * ] Notice: The portion of the term of this patent subsequent to Nov. 16, 1993, has been disclaimed.

[21] Appl. No.: 716,638

[22] Filed: Aug. 23, 1976

Related U.S. Application Data

[63] Continuation of Ser. No. 525,943, Nov. 21, 1974, Pat. No. 3,991,529.

[51] Int. Cl.[2] ..... E04C 2/20

[52] U.S. Cl. ..... 52/100; 52/314; 52/315; 428/43

[58] Field of Search ..... 35/26; 273/157 R; 428/43, 47–50, 79, 45; 52/98, 100, 315, 314, 316

[56] References Cited

U.S. PATENT DOCUMENTS

| | | | |
|---|---|---|---|
| 1,439,336 | 12/1922 | Smith | 273/157 |
| 1,977,444 | 7/1934 | Lowe | 161/145 |
| 2,139,620 | 12/1938 | Kirschbraun | 52/314 |
| 3,008,256 | 11/1961 | Rice | 52/98 |
| 3,131,514 | 5/1964 | Siek | 52/384 |
| 3,177,279 | 4/1965 | Bilodeau | 52/314 |
| 3,384,982 | 5/1968 | Herbert | 35/26 |
| 3,385,743 | 5/1968 | Blackberg | 161/145 |
| 3,466,217 | 9/1969 | Mott | 161/145 |
| 3,527,004 | 9/1970 | Sφrensen | 52/98 |
| 3,568,356 | 3/1971 | Berman | 46/16 |
| 3,706,626 | 12/1972 | Smith | 161/167 |
| 3,709,763 | 1/1973 | O'Neil | 161/167 |
| 3,770,535 | 11/1973 | Morrison | 35/26 |
| 3,991,529 | 11/1976 | Terwilliger | 52/100 |

FOREIGN PATENT DOCUMENTS

| | | | |
|---|---|---|---|
| 20,655 of | 1905 | Australia | 52/314 |

*Primary Examiner*—Price C. Faw, Jr.
*Assistant Examiner*—Henry Raduazo

[57] ABSTRACT

A simulated exterior surface assembly for creating the appearance of brick, stone, or the like. A sheet of plastic material, preferably vinyl, is provided with a series of simulated brick face sections or the like, defined by lines of weakening, where such sections are separable one from another by ordinary flexing. The sheet is provided with a peel-away self-adhesive allowing the simulated sections to be readily adhered onto a suitable undersurface. An optional arrangement includes the use of a mortar colored vinyl self-adhering backing material which is first placed on the undersurface and thereafter the individual simulated sections are suitably disposed thereon.

3 Claims, 2 Drawing Figures

TILE ASSEMBLY

Figure 1:
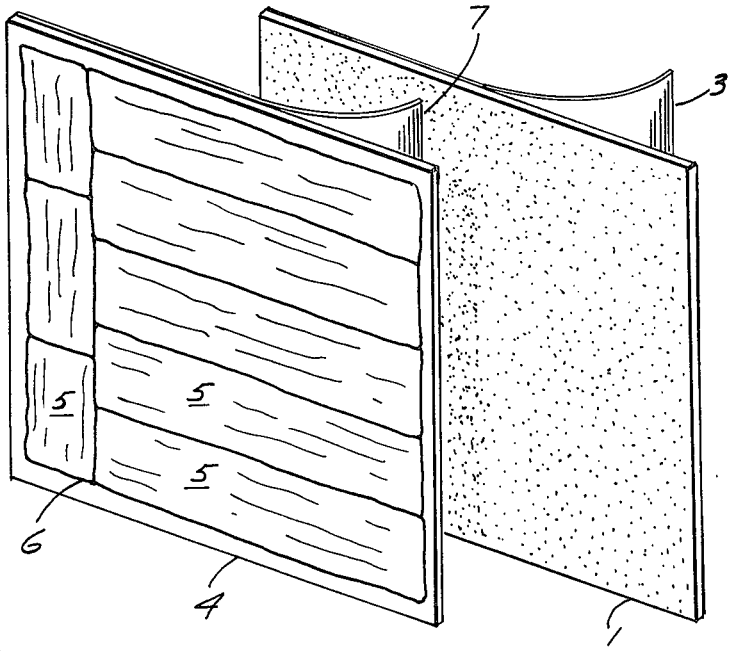

This is a continuation of application Ser. No. 525,943, filed Nov. 21, 1974, now U.S. Pat. No. 3,991,529.

The present invention is directed to a simulated brick or stone structure or the like. More particularly, the invention includes at least one major portion in the form of a simulated brick outer surface for application upon a suitable backing surface, such as, a second portion being textured to appear like mortar to simulate a cement layer between the successive courses of bricks.

By way of background, to use simulated brick or stone for interior and exterior purposes is quite well known. From a cost point of view, the use of synthetic materials having an outward appearance of natural bricks or stone of different types, such as: antique, spanish tapestry, white, etc., have been introduced into the market-place for some time. Such simulated facing materials have received wide acceptance by interior decorators and designers as a means of enhancing the aesthetic values of a room or surface areas. More commonly, the assembly takes the form of individual facing strips or squares containing a prescribed section which is to be adhered to a given area.

A common problem with such preformed sections or strips arises in joining such sections without seams being visible to the naked eye. Also from the end user's point of view, if such sections are not properly prepacked, exact sorting and disposition prior to installation are required.

In the case of preassembled panels of simulated brickwork or stones, there is the usual bulk associated with same, as well as, the limitation placed on the disposition, texture and format of the finished array. Where the product requires separate application of adhesive, the end user must be experienced in such application of cement so as to provide for a uniform simulated array of the finished product.

For example, installation of vinyl asbestos simulated materials by a layman is simplified by having a simulated brick or stone portion applied to an under surface, where the simulated material is provided with pressure sensitive adhesive on the back portion thereof. The importance of an easy to apply trouble-free tile not requiring a separate application of adhesive is quite important expecially when applied by non-professional "do-it-yourselfers."

Accordingly, it is the object of the present invention to eliminate the defects of the prior art.

It is still a further object of the present invention to provide for a simulated brick, stone, etc. assembly or the like which can be manufactured in a manner enabling easier packaging and freedom of breakage during transportation to the end user.

It is a further object of the present invention to provide a simulated brick assembly employing an adhesive peel-away backing material enabling ease of application without the use of additional adhesive for bonding the backing to a substrate.

A further object of the present invention is to provide a simulated brick assembly which includes a brick way section where the assembly has a predetermined contour with points of weakening that enable such brick surfaces to be snapped out of a main sheet or body of material.

It is contemplated that in actual use, a mortar color background is preferred, however, this can be varied and will be applied over the entire area to be treated.

For example, a brick or stone array to be applied thereto, is adhered with application of appropriate force to an underlaying surface. To do this, such simulated bricks or stones, etc. are broken along the scored lines in the sheet thereby producing individual pre-contoured and pre-shaped sections.

With the aforementioned arrangement, efficient production and packaging of such surfacing material is possible. However, it is within the contemplation of the present invention that other types of surfacing materials such as those made from wood, stone, ceramic tile, etc. could also lend itself to this type of an arrangement. Of noteworthy importance is the fact that it is possible to employ conventional vinyl asbestos tile equipment in the manufacturing operation of the component parts to the assembly. For example, an arrangement can take the form of groups of bricks having its back portion coated with a pressure sensitive adhesive and is designed to be scored in an outline of contiguous sections of approximately 2 × 8 inches. The sheet as received by the end user is about 12 × 12 inches. Furthermore, the edges of this sheet are provided with a protective border of about three-eighths of an inch. The inner scoreline of this border forms at least one edge of the interior brick configuration.

The use of vinyl materials is particularly important when dealing with shaping of corners or usual contouring which can be accomplished by heating and forming the portion to be applied.

The principal feature of the present invention includes a simulated exterior surface assembly including: a first portion, a second portion, and adhesive material on the back surface of at least said first portion, said first portion including a sheet of scored material defining a series of members for placement on said second portion; said second portion being provided with a background surface for receiving said exterior surface assembly to thereby from a unitary simulated structure.

Also within the scope of the present invention is a simulated brick assembly, wherein said first portion includes a plurality of predefined scored surfaces having lines of weakening in proximity with one another to separate therefrom by flexture of said first portion at such lines of weakening.

Other features which are considered as characteristic for the invention are set forth in the appended claims.

Figure 2:
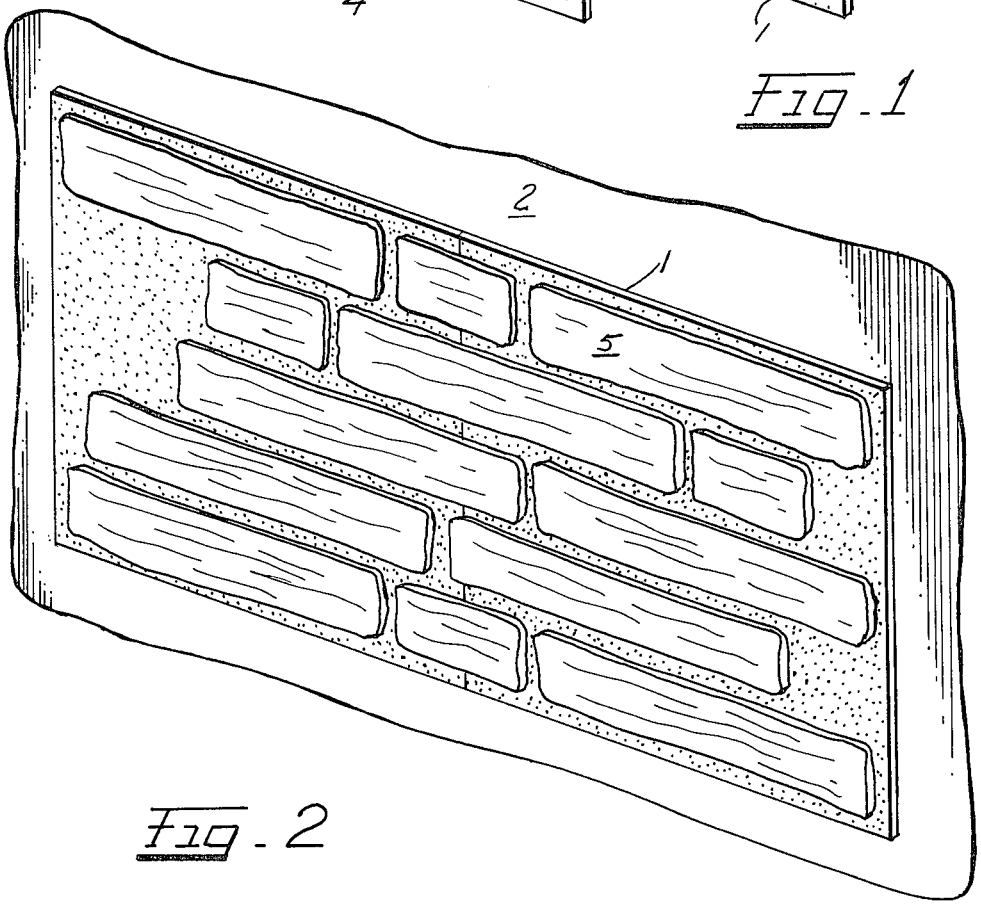

The invention, however, together with additional objects and advantages thereof, will be best understood from the drawing and description when read in connection with the accompanying drawing, in which:

FIG. 1 is a prospective view showing a first sheet of individual simulated tiles and a background sheet having a simulated mortar surface to receive the simulated tiles, and FIG. 2 is a prospective view showing the individual simulated tiles mounted on the simulated mortar surface.

The accompanying drawings illustrate a preferred embodiment, comprising background sheet 1 having a simulated mortar or cement upper surface a layer of a self-sticking adhesive material (not shown) disposed on the bottom surface, and a layer of protective paper 3 covering said adhesive layer. The sheet 1 can be applied to an underlying substrate surface 2 by removing the protective paper and applying ordinary hand pressure thereto in the area to which it is to be affixed. In addition, a sheet 4 of fracturable material having a series of simulated brick elements 5 and a protective marginal border area 8 all defined by a series of precontoured score-lines 6 is also provided. The lines 6 also define lines of weakness to permit the fracture of sheet 4 and the separation of the brick elements 5 therefrom by ordinary hand pressure. The different sizes and contours of brick or stone surfacing materials are then at hand for adherence to the background sheet 1. The sheet 4 from which the simulated brick elements are snapped out also includes a layer of adhesive material (not shown) on the bottom surface and a layer of a backing paper 7 to protect such adhesive Once the paper 7 is removed, the simulated brick elements 5 may be applied to the background sheet 1 by ordinary hand pressure.

The arrangement described above can likewise be employed without the use of mortar colored background sheet in order to achieve the desired aesthetic effect. For example, a wall can be painted and simulated bricks applied directly.

To minimize some or all of the aforementioned problems, however, the present invention provides a unitary structure of simulated brick or stone profiles which are held together at mutual lines of weakening and is manufactured and shipped to the end user in the form of a sheet. At the time of installation, the end user merely has to snap off simulated brick components and separate them one from the other by ordinary hand pressure. The sheet contains sufficient numbers of different facing profiles to enable development of different arrays and patterns. As part of the overall assembly, the sheet material is provided with an adhesive backing, enabling the user to immediately apply such brick profiles to a common area without the need for adhesive materials. In addition, a suitable background sheet can be provided simulating the texture and color of cement mortar so as to allow the adhered profiles to create the appearance of a true brick assembly. The use of such cement-looking background sheet is optional and can be supplemented with other compatible backing materials.

Although the invention is illustrated and described herein as a simulated brick structure or the like, it is nevertheless not intended to be limited to the details shown, since various modifications may be made therein without departing from the spirit of the invention and within the scope and range of the equivalents of the claims.

I claim:

1. A tile assembly comprising a sheet of breakable vinyl plastic material having a first series of interconnected score lines formed therein defining a protective marginal border area between such lines and the peripheral edge of the sheet extending around the perimeter of the sheet, and a second series of interconnected score lines formed therein disposed interiorly of said marginal border area and defining with said first series of score lines a plurality of individual connected tile elements, substantially each of said tile elements having a peripheral shape and configuration complementary with adjacent portions of the assembly, and said tile elements having a decorative upper surface; each of said tiles and said marginal border area having uniform and equal thickness; said marginal border area being defined by a dimension extending perpendicularly between a peripheral edge of the sheet and a tile element which is substantially less than substantially all dimensions of said tile elements; said first and second series of score lines further defining lines of weakness to permit breakage of the sheet by hand pressure along said score lines and the separation of the protective marginal border area and each individual tile therefrom.

2. A tile assembly in accordance with claim 1, further comprising a background sheet having an upper surface with a simulated mortar configuration formed therein, and an under surface adapted for application to a substrate; said upper surface being adapted to receive thereon the individual tiles in any desired pattern or configuration upon the separation of such tiles from said fracturable sheet to form a unitary multi-tile structure.

3. A tile assembly in accordance with claim 1, further comprising a layer of self-sticking adhesive material disposed on the underside of the fracturable sheet; and a layer of removable protective paper disposed on the underside of said adhesive layer.

* * * * *